US011788317B2

(12) United States Patent
Corcoran et al.

(10) Patent No.: US 11,788,317 B2
(45) Date of Patent: Oct. 17, 2023

(54) CELL PHONE CANOPY

(71) Applicants: Kathryn Corcoran, Gretna, NE (US); Ryan Corcoran, Gretna, NE (US); Brent Benson, Papillion, NE (US)

(72) Inventors: Kathryn Corcoran, Gretna, NE (US); Ryan Corcoran, Gretna, NE (US); Brent Benson, Papillion, NE (US)

( * ) Notice: Subject to any disclaimer, the term of this patent is extended or adjusted under 35 U.S.C. 154(b) by 191 days.

(21) Appl. No.: 17/159,269

(22) Filed: Jan. 27, 2021

(65) Prior Publication Data

US 2022/0098894 A1 Mar. 31, 2022

Related U.S. Application Data

(60) Provisional application No. 63/084,291, filed on Sep. 28, 2020.

(51) Int. Cl.

| | |
|---|---|
| ***E04H 15/14*** | (2006.01) |
| ***E04H 15/54*** | (2006.01) |
| ***E04H 15/44*** | (2006.01) |
| ***A45C 11/00*** | (2006.01) |
| ***E04H 15/58*** | (2006.01) |

(52) U.S. Cl.

CPC ..... *E04H 15/14* (2013.01); *A45C 11/00* (2013.01); *E04H 15/44* (2013.01); *E04H 15/54* (2013.01); *E04H 15/58* (2013.01); *A45C 2011/002* (2013.01)

(58) Field of Classification Search

CPC ... E04H 2015/209; E04H 15/02; E04H 15/54; E04H 15/44; E04H 15/14; E04H 15/58; A45C 11/00; A45C 2011/002

USPC ..... 206/320; 135/91

See application file for complete search history.

(56) References Cited

U.S. PATENT DOCUMENTS

| | | | | |
|---|---|---|---|---|
| 6,772,883 | B2 * | 8/2004 | Lindamood | A45F 3/04 206/320 |
| 8,714,174 | B1 * | 5/2014 | DeSousa | E04H 15/58 135/117 |
| 10,676,954 | B1 * | 6/2020 | Oppenheim | E04H 15/14 |
| 2003/0056817 | A1 * | 3/2003 | Miller | H04N 5/65 135/117 |
| 2004/0206645 | A1 * | 10/2004 | Roubanis | A45C 11/24 206/320 |

(Continued)

FOREIGN PATENT DOCUMENTS

| | | | | |
|---|---|---|---|---|
| KR | 20090079212 A | * | 7/2009 | |
| WO | WO-2019213670 A1 | * | 11/2019 | E04H 15/04 |

*Primary Examiner* — Rafael A Ortiz

(74) *Attorney, Agent, or Firm* — Brennan, Manna & Diamond, LLC

(57) ABSTRACT

This present invention relates to an electronic device canopy designed to provide protection to an electronic device from the sun, and other weather elements. The electronic device canopy is comprised of a collapsible frame that includes a plurality of legs and cross members, and a canopy fabric that is supported by the collapsible frame. The canopy fabric is comprised of a weather resistant, waterproof and UV protective material or coating. At least one side of the canopy fabric may be rolled up and secured to a top surface to provide the user with access to the interior space of the canopy and the electronic device stored therein. A carrying case may also be included to store and carry the electronic device canopy when not in use.

17 Claims, 4 Drawing Sheets

(56) References Cited

U.S. PATENT DOCUMENTS

| | | | | |
|---|---|---|---|---|
| 2010/0059095 | A1* | 3/2010 | Hinz | E04H 15/54 135/120.1 |
| 2013/0254989 | A1* | 10/2013 | Garcia | A47C 21/044 5/421 |
| 2015/0034137 | A1* | 2/2015 | Tanaeim | E04H 15/54 29/428 |
| 2019/0218813 | A1* | 7/2019 | Nelson | E04H 15/38 |
| 2019/0269209 | A1* | 9/2019 | Akin | H01L 31/042 |
| 2020/0102766 | A1* | 4/2020 | Carter | E04H 15/56 |
| 2020/0157835 | A1* | 5/2020 | Dresch | E04H 15/58 |
| 2020/0217100 | A1* | 7/2020 | Xu | E04H 15/405 |
| 2020/0270893 | A1* | 8/2020 | Aloumanis | E04H 15/02 |
| 2021/0032897 | A1* | 2/2021 | Hutnak | E04H 15/54 |
| 2021/0376658 | A1* | 12/2021 | Marino | A45C 15/00 |

* cited by examiner

CELL PHONE CANOPY

CROSS-REFERENCE TO RELATED APPLICATION

The present application claims priority to, and the benefit of, U.S. Provisional Application No. 63/084,291, which was filed on Sep. 28, 2020 and is incorporated herein by reference in its entirety.

FIELD OF THE INVENTION

The present invention relates generally to the field of accessories for a smart device. More specifically, the present invention relates to a small canopy device designed to prevent a cell phone or other smart device from overheating while in the sun, and to protect the same from other extreme weather conditions, such as rain, snow, sleet, and the like. In one embodiment, the canopy is a cube or other shaped structure with four fabric side walls, a fabric top, and an optional fabric bottom for use in sand, dirt, or grass. Nonetheless, other embodiments may include pyramid, round, star-like, cylinder or other geometric or non-geometric configurations or shapes. At least one side or panel of the canopy structure can be easily folded up to access the interior of the canopy structure and the smart device or other object contained therein. Said side or panel may further be comprised of a screen or a transparent material that provides the necessary protection, but also allows the screen of the smart device to be viewed by the user. Further, the cell phone canopy of the present invention is collapsible into a small bag for easy set up and transportation. In a collapsed condition, the cell phone canopy is relatively small, and can be easily placed into a pocket, purse, beach bag, knapsack, satchel, or the like. Accordingly, the present disclosure makes specific reference thereto. Nonetheless, it is to be appreciated that certain aspects of the present invention are also equally applicable to other like applications, devices and methods of manufacture.

BACKGROUND OF THE INVENTION

By way of background, the use of smart devices, such as cell phones, tablets, smart watches and the like, has increased dramatically in recent years and around the world. Such technological devices play a largely indispensable role in the daily lives of people around the world, and are used for communication, entertainment, learning and other purposes. Typically, such smart devices are portable so that the user can easily carry the device with them regardless of their destination. Unfortunately, smart devices exposed to extreme weather conditions, such as rain, snow, sleet or the like, may result in significant damage to the device and render it inoperable. The damage to the smart device not only makes the device unusable, but also causes significant inconvenience to the user who may then lack access to cellular communication, entertainment or other relevant features on the smart devices. The damaged device may also cause the loss of critical user data stored in the device if the exposure causes irreparable damage to the electronics contained in the device. Further, the damaged smart device may also lead to financial loss to the user, who then must pay to either repair or replace the damaged device.

In an effort to combat such exposure to the elements, some smart device users may elect to carry an umbrella when using the device during episodes of precipitation. However, in such instances, the user is required to hold the umbrella with at least one hand, thereby making it difficult for the user to also use the smart device such as when texting or responding to emails. Also, the user may not always remember to carry an umbrella while going out, as the umbrella occupies space and requires an additional effort. Other accessories, such as covers for various smart devices, are available on the market to protect the device from inclement weather. However, such covers typically cause the smart device to overheat due to the lack of air circulation around the covered device, and/or make it difficult for the user to fully utilize the device because of the presence of the cover.

Smart devices may also suffer irreparable damage if exposed to extreme heat for even short periods of time. For example, a smart device, such as cell phone or tablet, may be damaged if left in a car or a vehicle parked in the sun, or if the device is continuously exposed to sun and overheats. The sun and the heat associated therewith not only renders the device temporarily useless when it becomes too hot, but may also prematurely drain the battery. In some instances, such overheating may also cause the battery to explode or catch on fire, which not only causes permanent damage to the device, but also may cause injury to the user or those nearby. Further, even if the device is not damaged during direct exposure to sunlight, the presence of the sunlight on the screen of the device creates a glare that makes the screen contents difficult for the user to read.

Therefore, there exists a long felt need in the art for a device that protects smart devices, such as a cell phone, tablet, smart watch or the like, from extreme weather conditions, as well as from overheating due to exposure of the device to the sun. There is also a long felt need in the art for a canopy device that is waterproof, and that is capable of accommodating smart devices of different sizes and configurations. Moreover, there is a long felt need in the art for a canopy device that not only protects the smart device, but that also enables the same to be used by a user during the period of protection. Additionally, there is a long felt need in the art for a canopy device that allows the user to easily view the screen when in the sun, and that prevents sun glare on the screen, thereby making the same easier to view by the user. Finally, there is a long felt need in the art for a smart device canopy that is collapsible into a compact state when not in use, relatively inexpensive to manufacture, and both safe and easy to use.

The subject matter disclosed and claimed herein, in one embodiment thereof, comprises a canopy structure for protecting smart devices, such as cell phones, tablets, and other electronic devices, from over exposure to the sun and other weather conditions such as rain, snow or the like. The canopy is a shaped structure that has tubular legs, a top frame and a bottom frame, with a canopy fabric covering all of the sides and the top frame. The bottom frame may be optionally covered with the fabric or other material as per the particular application or requirements of the user, and depending upon whether the structure requires a closed bottom. At least one side of the canopy may be rolled up and/or secured to access an electronic device kept inside the canopy structure. The openable side may also have a screen or transparent panel which protects the enclosed device from the elements while still allowing the screen of the smart device to be visible to the user. The canopy device of the present invention is foldable/collapsible and may be marketed with a smart bag to store and carry the device when not in use to create a unique consumer offering.

In this manner, the novel smart device canopy of the present invention accomplishes all of the forgoing objectives, and provides a relatively safe, easy, convenient and cost-effective solution to protecting smart devices from exposure to various weather conditions, such as the sun, rain, snow, sleet, etc. The smart device canopy of the present invention is also user friendly, inasmuch as the canopy effectively protects the smart device of the user, but still allows the same to be used during periods of protection. The canopy is relatively lightweight, portable, and easy to set-up and/or collapse when no longer needed.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a protective shading device for a handheld computer or smart device comprising a one-piece, collapsible frame having a set of four legs divided into a pair of front legs and a pair of rear legs, a top frame surface, and a bottom frame surface. Each leg has suction caps or feet at its bottom to secure or stabilize the frame on a surface. A canopy is attached to the frame and forms a housing by covering the top frame surface, bottom frame surface and each of the side surfaces between the legs. The canopy between the pair of front legs is free from the bottom edge and may be rolled up to keep or provide access to a handheld computer device. When the shading device is no longer needed to protect the smart device, the canopy may be removed from the frame and the legs may be folded to reposition the shading device into a collapsed position to be kept in a carry bag for easy storage and/or transportation.

In a further embodiment of the present invention, the canopy portion of the shading device covers the top and side surfaces of the frame, but does not cover the bottom frame surface. Nonetheless, in each of the various embodiments described herein, the canopy material is UV resistant and prevents direct sunlight and UV rays from permeating the material and causing the handheld electronic or computer device to overheat. The canopy material also protects the screen of the smart device from receiving too much sun glare, which makes it difficult for a user to view.

In a further embodiment of the present invention, a handheld electronic device canopy to provide protection from the sun and other weather elements is disclosed. The handheld electronic device canopy comprises a collapsible frame having a plurality of legs, and a canopy fabric attached to the legs such that the canopy fabric covers the side panels, top panel and bottom panel formed by the legs. Once the handheld electronic device canopy has been constructed, the handheld electronic device may be kept on the canopy fabric covering the bottom panel within the canopy structure. Further, the canopy fabric covering at least one of the side panels, or face of the canopy, may be rolled up to provide a user with access to the smart device stored within the canopy while still protecting the same from direct sunlight and other weather elements that could cause harm to the smart device is exposed to the same. Additionally, the bottom portion of each leg of the frame may further comprise a suction cup, foot or other support to secure the canopy structure to a surface upon which the structure is placed, wherein the bottom panel of the structure may be somewhat elevated above said surface. The feet or support may also be weighted to provide additional support to the canopy structure, and to prevent the canopy structure from blowing away or overturning in the wind.

In yet a further embodiment of the present invention, a canopy structure for protecting smart devices, such as a cell phones, tablets, and other electronic devices, from direct sunlight and other weather conditions such as rain, snow or the like is disclosed. The canopy structure is comprised of a plurality of equidistantly spaced tubular legs, wherein the legs form a cube like structure having a top frame, a bottom frame and four side frames. The canopy structure further comprises a fabric or canopy that may be stretched across each of frames to completely encompass the cube-like frame, except that at least one of the side panels of the canvas may be rolled up to provide the user with access to an electronic device kept inside the canopy structure. The canopy or fabric is preferably both waterproof and UV resistant, and may further comprise one or more transparent panels to allow a user to view inside the canopy structure to, for example, view the screen of the electronic device stored therein. When no longer needed, the canopy or fabric may be removed from the frame and the frame collapsed for easy transportation or storage of the canopy structure.

In a still further embodiment of the present invention, a combination smart device canopy and carrier is disclosed. The combination smart device canopy and carrier comprises a shaped canopy and a carrier having an interior dimension. The shaped canopy has a series of side walls, top and bottom walls, wherein each of the walls is covered with a fabric. The fabric is selected from a group including plastics, natural and synthetic fibers, recyclable materials, renewable fibers, or combinations thereof. The shaped canopy is movable from an open position to a collapsed position, wherein when the shaped canopy is in the collapsed position it easily fits within the interior dimension of the carrier. Each of the walls of the shaped canopy is waterproof, and has an ultraviolet protection factor ranging from 5 to 50.

The handheld electronic device canopy product of the present invention protects the smart device from the elements, overheating, sun glare and theft, as the smart device is concealed from view. All the legs of the canopy product are preferably substantially the same in height and in a deployed position, the canopy device may form a cube, pyramid, circle, or other geometric shape. Alternatively, the height of the legs may be more than the distance between the legs in a deployed position. When in a stowed position, the handheld electronic device canopy product easily collapses into a small bag for storage or transportation, and conveniently fits into a pocket, purse, beach bag, or the like.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE INVENTION

Figure 1:
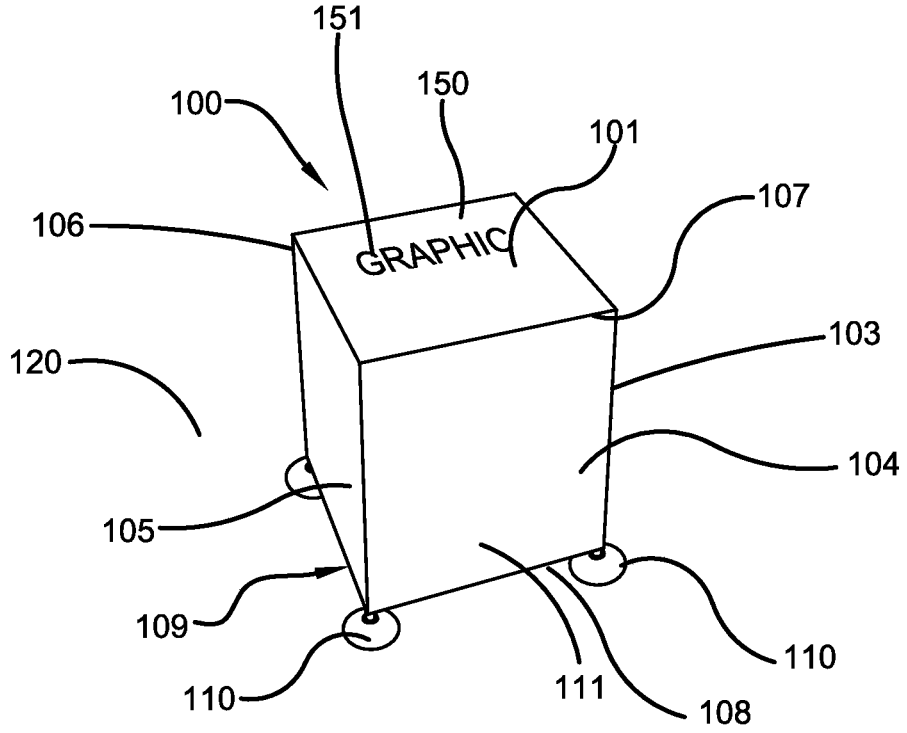
FIG. 1 illustrates a perspective view of one potential embodiment of the electronic device canopy of the present invention in use at the beach in accordance with the disclosed architecture specification, wherein the electronic device canopy is in a fully deployed position.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long felt need in the art for a canopy or tent like device that protects smart devices, such as a cell phone, tablet, smart watch or the like, from extreme weather conditions, as well as from overheating due to exposure from the sun. There is also a long felt need in the art for a canopy device that is waterproof, and that is capable of accommodating smart devices of different sizes and configurations. Moreover, there is a long felt need in the art for a canopy device that not only protects the smart device, but that also enables the same to be used by a user during the period of protection. Additionally, there is a long felt need in the art for a canopy device that allows the user to easily view the screen of the electronic device when in the sun, and that prevents sun glare on the screen, thereby making the same easier to view by the user. Finally, there is a long felt need in the art for a smart device canopy that is collapsible into a compact state when not in use, relatively inexpensive to manufacture, and both safe and easy to use.

The present invention, in one exemplary embodiment, is a novel shading device for a handheld smart device comprising a cube-like frame having a set of four legs divided into a pair of front legs and a pair of rear legs, a top frame surface, and a bottom frame surface. Each leg has a suction cap or other support positioned at its bottom to secure the frame. A canopy is attached to the frame and forms a housing thereover by covering the top frame surface, bottom frame surface and the side surfaces. Notwithstanding, the portion of the canopy between the pair of front legs is free along its bottom and side edges and may be rolled up in the direction of the top frame surface to provide a user with access to a handheld electronic device being stored within the shading device. The legs of the device are also foldable so that the shading device may be collapsed into a compact position when not in use and stored or transported in an accompanying carrying case.

Referring initially to the drawings, FIG. 1 illustrates a perspective view of one potential embodiment of the electronic device canopy 100 of the present invention in use at the beach in accordance with the disclosed architecture specification, wherein the electronic device canopy 100 is in a fully deployed position. More specifically, the electronic device canopy 100 is preferably a cuboidal or cubical shaped structure comprised of a tubular structured frame 109 and a canopy fabric 150 encasing all or a substantial portion of the frame 109. The structured frame 109 is preferably comprised of four generally vertical and spaced apart legs 1090, 1091, 1092, 1093 and a pair of cross members 1095 that extend diagonally between the top portions of legs 1090 and 1092, and between the top portions of legs 1091 and 1093, respectively, to form a top frame 107. Each of the legs 1090, 1091, 1092, 1093 and cross members 1095 are preferably comprised of a relatively lightweight metal, wood, plastic, composite or other durable material.

Figure 2:
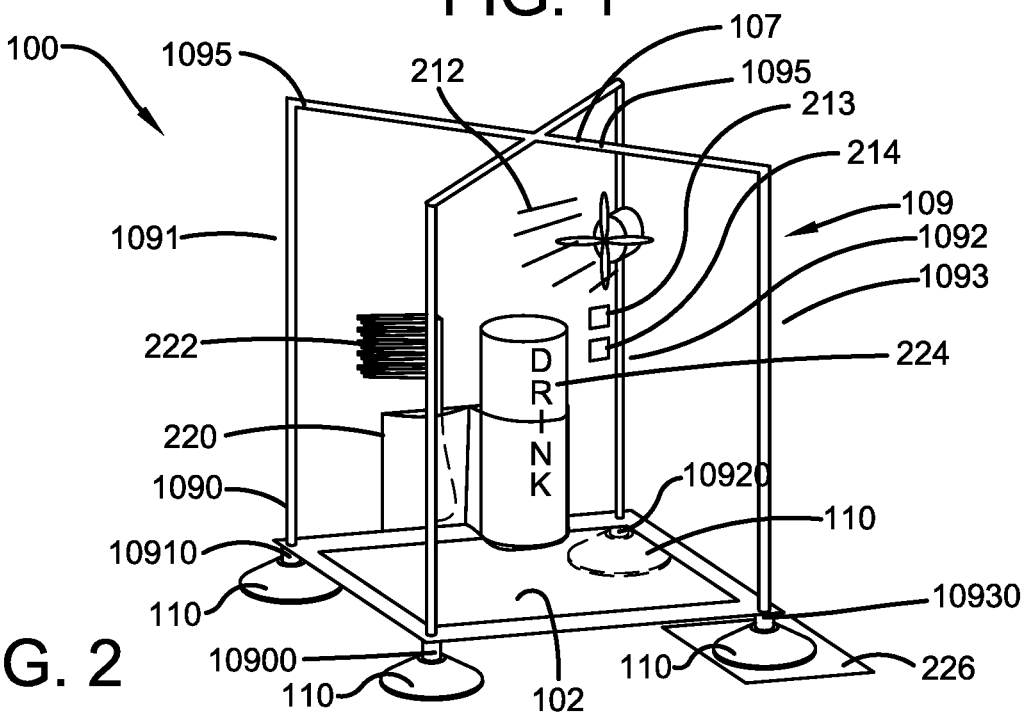
FIG. 2 illustrates a perspective view of one potential embodiment of the frame structure on which the canopy fabric is attached to form the handheld electronic device canopy of the present invention in accordance with the disclosed architecture.

As best shown in FIGS. 1 and 2, each of the legs 1090, 1091, 1092, 1093 has a suction cup, feet or other supporting structure 110 positioned at its bottom (i.e., opposite its top portion) to support and secure the electronic device canopy 100 on a platform or other surface, such as sand 120 on a beach. As explained more fully below, the frame 109 is easily repositionable between a fully deployed position (as best shown in FIGS. 1-4), and a fully stowed or collapsed position (as best shown in FIG. 5). In the fully collapsed position, the overall canopy device 100 and the frame 109 in particular are relatively compact, and easy to store and/or transport from one location to another. In the fully deployed condition, the frame 109 is capable of both supporting the canopy fabric 150 and protecting a smart device, such as a cell phone 111.

Figure 3:
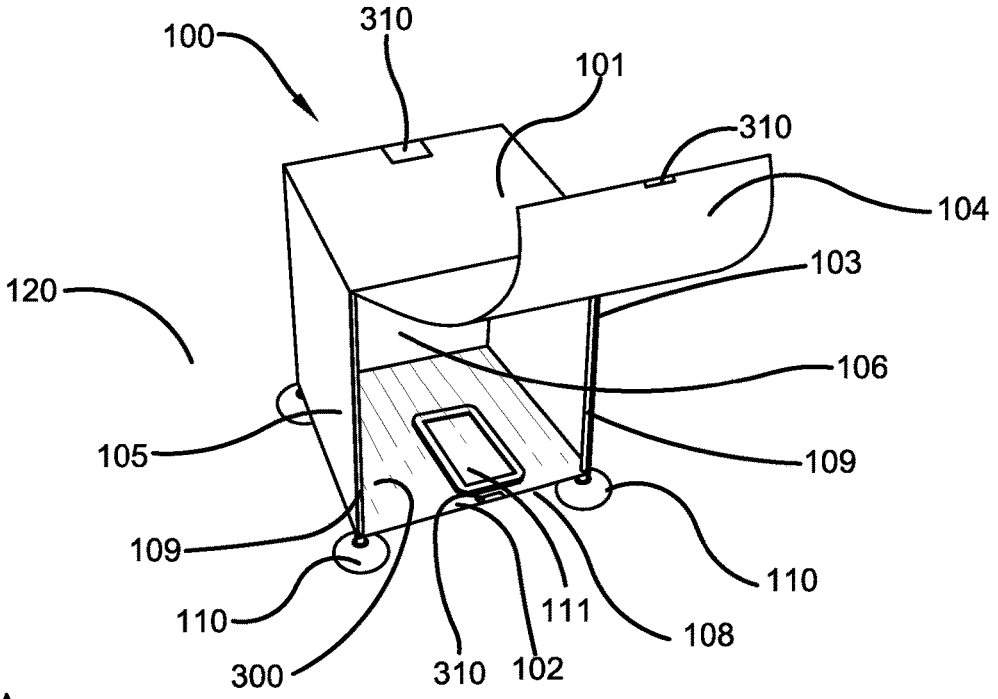
FIG. 3 illustrates a perspective view of one potential embodiment of the electronic device canopy of the present invention in use at the beach in accordance with the disclosed architecture, wherein the front panel of the canopy has been raised to expose the presence of an electronic device stored within the electronic device canopy.

More specifically, and as best shown in FIGS. 1-3, the canopy fabric 150 may be positioned over or around the tubular frame structure 109 to form the fabric side surfaces 103, 104, 105, 106 between adjacent legs, a top surface 101 covering the top frame 107, and a bottom surface 102. The canopy fabric 150 may be further comprised of graphics or indicia 151. For example, the graphics or indicia 151 may represent a manufacturer or other promotional activity, and the canopy structure 100 could be part of a promotional giveaway at the beach. When properly positioned over the frame 109, the canopy fabric 150, in the form of side surfaces 103, 104, 105, 106, top surface 101 and bottom surface 102, forms a housing which provides protection against sunlight, snow, rain, sleet, wind and other elements for the handheld electronic device kept within the canopy structure 100 (e.g., on the bottom surface 102). Further, when forming a cube, the top surface 101, bottom surface 102 and each of side surfaces 103, 104, 105, 106, are of the same dimensions. Nonetheless, as described more fully below and illustrated in FIGS. 7 and 8, the canopy device 100 of the present invention is not so limited, and may also take the form of other geometric and non-geometric shapes provided that the same accomplish the above stated objectives.

The electronic device canopy 100 can be used on lawns, on sand 120, by a pool, on a lounge chair, on tables, or in any other location where shade is desired for an electronic device or the enclosure is needed to protect against the elements. For example, a smartphone 111, PDA, laptop, smart watch, tablet or any other similar electronic device can be kept on the bottom surface 102 of the canopy device 100 to protect the same from inclement weather and/or direct sunlight, both of which may cause damage and/or ruin an unprotected device.

The canopy material 150 is preferably comprised of a relatively thin piece of nylon, canvas, or weather resistant polyester. Notwithstanding, it is also contemplated that the canopy material 150 may be comprised of recycled materials, plastics, natural and synthetic fibers and fabrics, renewable fibers and fabrics, bamboo and the like. In a preferred embodiment of the present invention, the canopy fabric 150 may be removably attached to the frame 109 or top frame 107 by any attachment means known in the art such as, without limitation, hook and loop fasteners, buttons, snaps, ties, etc. In an alternative embodiment, the canopy fabric 150 may be simply placed over the frame 109 and top frame 107 and hang downwardly therefrom, particularly when the same does not include a bottom surface 102.

FIG. 2 illustrates a perspective view of one potential embodiment of the frame structure 109 on which the canopy fabric 150 is attached to form the handheld electronic device canopy 100 of the present invention in accordance with the disclosed architecture. More specifically, the frame 109 is comprised of a pair of front legs 1090, 1093, and a pair rear legs 1091, 1092. All of the legs are preferably of equal height, and are equidistant from one another. Nonetheless, it is also contemplated that one or more of the legs may be telescoping so that the canopy device 100 may be used on an uneven surface. Further, as stated above, a pair of cross members 1095 extend diagonally between the top portions of legs 1090 and 1092, and between the top portions of legs 1061 and 1093, respectively, to form a top frame 107, and complete the frame 109. Each of the legs and cross members 1095 may be constructed from a plastic, such as polypropylene or polyethylene, an aluminum, bamboo or any other durable material that may form a rigid shaft.

Each leg 1090, 1091, 1092, 1093 has identical feet 110 positioned at their respective bottom ends 10900, 10910, 10920, 10930 to support the frame 109 on a surface. In one embodiment, the frame 109 may be formed as a single unit with no modular components, wherein the cross members 1095 connecting each of the various legs may be hinged at their midpoints (not shown) so that the entire frame 109 may collapse inwardly on itself with each of the four legs 1090, 1091, 1092, 1093 touching each other in a collapsed condition. In another embodiment, the various components of the frame 109 may be comprised from an elastic metal material, such as a screen or mesh, that is capable of withstanding thousands of bends without failing.

As stated above, the canopy fabric 150 may be attached to the frame 109 in a variety of different ways, or may simply be positioned over top of the same. Inasmuch as one of the primary objectives of the canopy device 100 is to protect a smart device stored therein from the elements and direct exposure to sunlight, the canopy fabric 150 should be both waterproof and/or UV resistant. For example, the canopy material 150 preferably has an ultraviolet protection factor or UPF ranging between 5 and 50 UPF, and more preferably between 25 to 50 UPF. Accordingly, the canopy fabric 150 may be comprised of such waterproof and/or UV resistant materials, or appropriate waterproof and UV resistant coatings may be applied thereto post manufacturing.

As also shown in FIG. 2, the canopy device 100 may be further comprised of a battery-powered fan 210, which helps to circulate the air 212 within the canopy device 100 and facilitate cooling. The fan 210 may be further comprised of a temperature sensor (not shown) that causes the fan 210 to automatically power on when the interior of the canopy device 100 reaches a certain temperature. The batteries 213 may be disposable batteries or rechargeable batteries, and may also power a USB port 214 that can be used to recharge the smart device 211. Additionally, there should also be sufficient air or head space within the canopy device 100 between the smart device 111 and the side surfaces 103, 104, 105, 106 and/or top surface 101. Experimental testing has shown that an air space within the canopy interior, ranging from between 10 and 25 times the size of the smart device 111, will provide sufficient air space to keep the device 111 from overheating. In a further embodiment of the present invention, the canopy device 100 may also comprise a light 215 in communication with the smart device 111, wherein the light 215 may automatically turn on, for example, when the smart device 111 receives a call or text, or when an alarm clock on the smart device 111 goes off. The light 215 may also be powered by the batteries 213.

The canopy device may also be equipped with one or more pockets 220, which may be used to hold personal care items, such as a comb or brush 222, lotions, consumer goods intended for consumption, such as beverages 224, or any other item that a user may desire to have at the location where the canopy device 100 is being used. FIG. 2 also illustrates the use of weights 226 which may be placed on the feet 110 to help prevent the canopy device 100 from blowing away or overturning when used in windy conditions. The weights 226 may be permanently applied to the structure, or may be removed when not needed. The weights 226 preferably range from about 8 ounces to two pounds.

FIG. 3 illustrates a perspective view of one potential embodiment of the electronic device canopy 100 of the present invention in use at the beach in accordance with the disclosed architecture, wherein the front panel 104 of the canopy fabric 150 has been raised to expose the presence of an electronic device 111 stored within the electronic device canopy 100. More specifically, an electronic device, such as a cell phone 111, may be placed on the bottom surface 102 formed by the canopy material 150, thereby supporting the same off of the ground. In this instance, the handheld electronic device canopy 100 is shown in a fully deployed position on sand 120 at a beach, wherein the weighted feet 110 help to maintain the device 100 in an upright position.

Further, the front panel 104 is rolled up to provide a user with access to the cell phone 111 while it remains on the bottom surface 102. Each of the canopy fabric 150 and the front panel 104 may further comprise one or more fasteners 310 which cooperate to hold the front panel 104 in an open or closed position, as desired by the user. Nonetheless, in a preferred embodiment, none of the remaining sides or panels 103, 105, 106 can be repositioned, thereby providing a single access point to the interior of the canopy device 100. Multiple electronic devices 111 can be kept on the bottom surface 102 to protect the same from inclement weather and/or direct sunlight. In an alternative embodiment of the present invention for use in, for example, a home or office, the bottom surface 102 may be eliminated.

Figure 4:
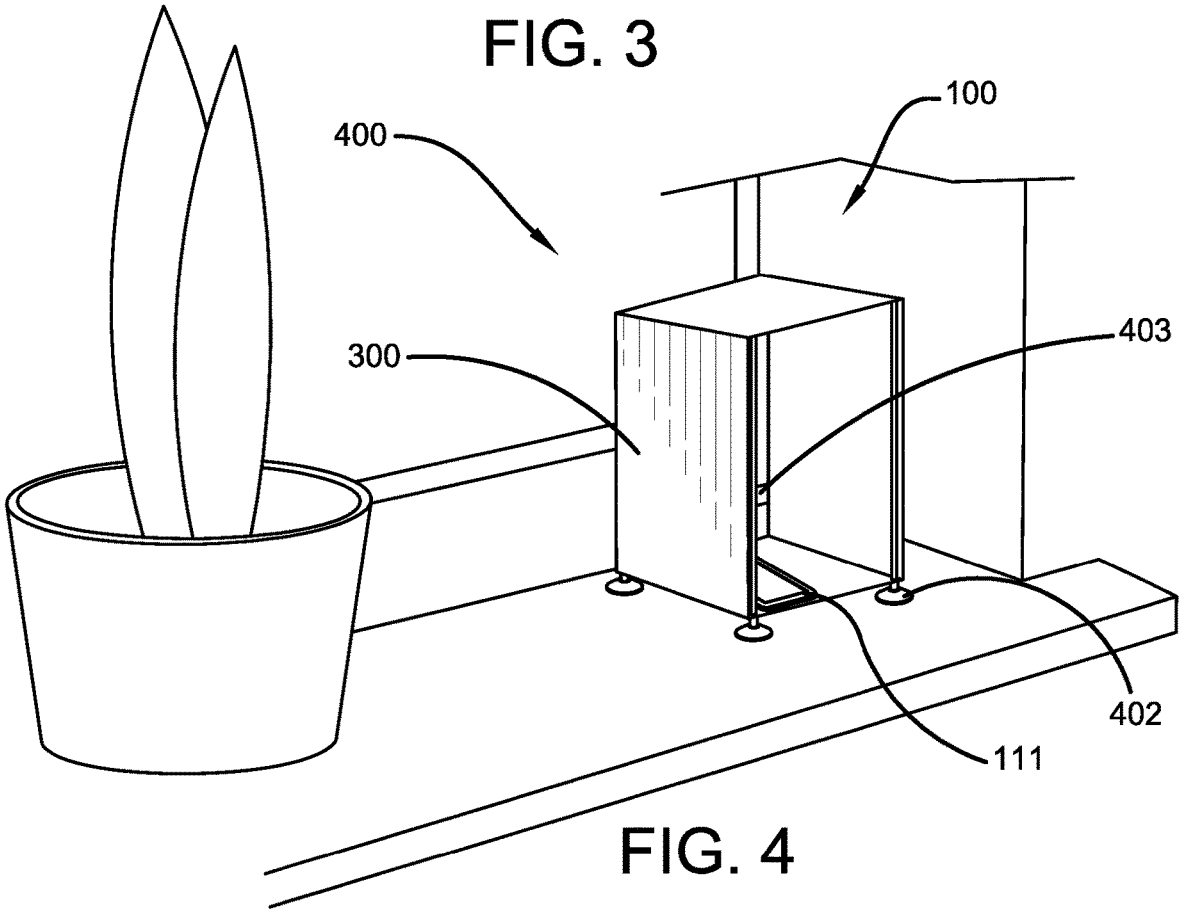
FIG. 4 illustrates a perspective view of one potential embodiment of the electronic device canopy of the present invention in use on a shelf in a room in accordance with the disclosed architecture, wherein the front panel of the canopy has been raised to expose the presence of an electronic device stored within the electronic device canopy.
Figure 5:
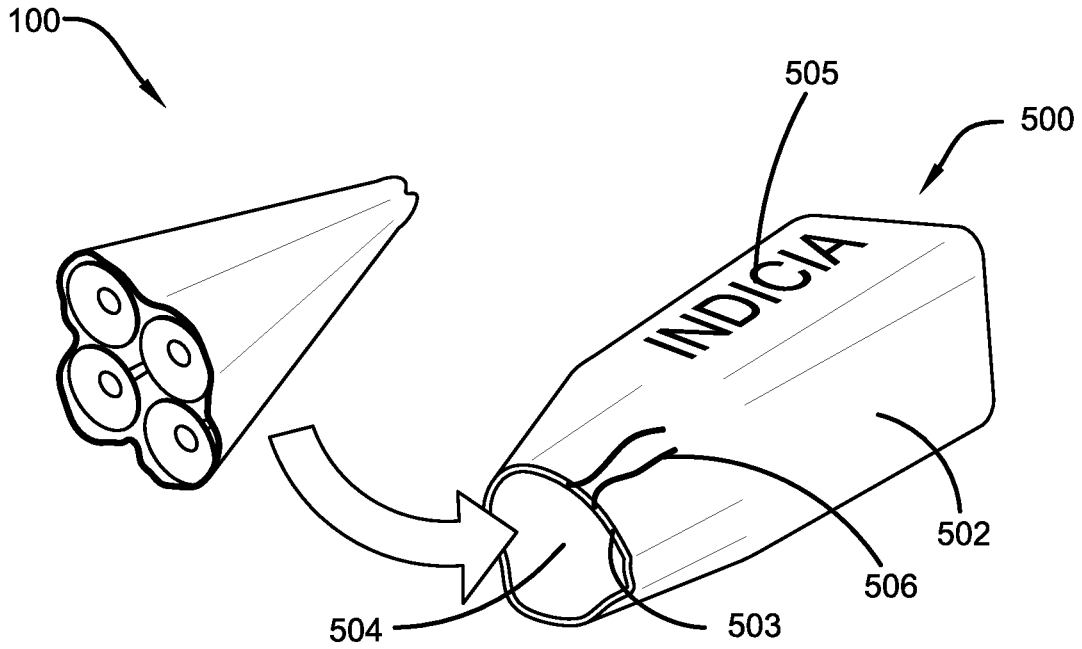
FIG. 5 illustrates a perspective view of one potential embodiment of the electronic device canopy of the present invention and a convenient carrying case in accordance with the disclosed architecture, wherein the electronic device canopy is in a fully stowed position.

FIG. 4 illustrates a perspective view of one potential embodiment of the electronic device canopy 100 of the present invention in use on a shelf 402 in a room in accordance with the disclosed architecture, wherein the front panel of the canopy fabric 150 has been raised to expose the presence of an electronic device 111 stored within the electronic device canopy 100. More specifically, the electronic device canopy 100 is being used to protect a cell phone 111 from direct sunlight 300 coming into the room from a window 400. In this manner, the cell phone 111 remains in the shade provided by the canopy device 100 and will not overheat, as most (if not all) of the sunlight 300 is reflected by the canopy material 150. The canopy material 150 preferably reflects or otherwise blocks more than 90% of the sun's UV rays to prevent the same from overheating, and also insulates the electronic device 111 to an extent from the cold, such as through the air or head space. In one embodiment, the rear surface or rear fabric panel has an opening 403 therein for a charging cable or earphone cord, and a lockable front zipper fabric panel. The canopy device 100 does not reduce the sound of the electronic device 111, thereby allowing audio from the electronic device 111 held in the canopy device 100 to come out (e.g., through the open panel) with minimal, if any, disruption.

FIG. 5 illustrates a perspective view of one potential embodiment of the electronic device canopy 100 of the present invention and a convenient carrying case 500 in accordance with the disclosed architecture, wherein the electronic device canopy 100 is in a fully collapsed or stowed position for easy transportation. More specifically, in all of its various embodiments, the canopy device 100 is collapsible such that all four of the legs are collapsed to touch each other. Further, the canopy device 100 may be stored or transported in a carrying case 500 comprised of a pouch like fabric 502 having an opening 503 therein that leads to an interior cavity 504. After inserting the canopy device 100 into the interior cavity 504, a string 506 present around the pouch opening 503 can be pulled by a user to secure the canopy device 100 in the case 500. Additionally, the case 500 may have the same or different logos, indicia, trademarks, geometric patterns, customizable colors and fonts, embroidery and prints, and/or other images 505 on the exterior surface as those present on the canopy material 150 of the canopy device 100.

Figure 6:
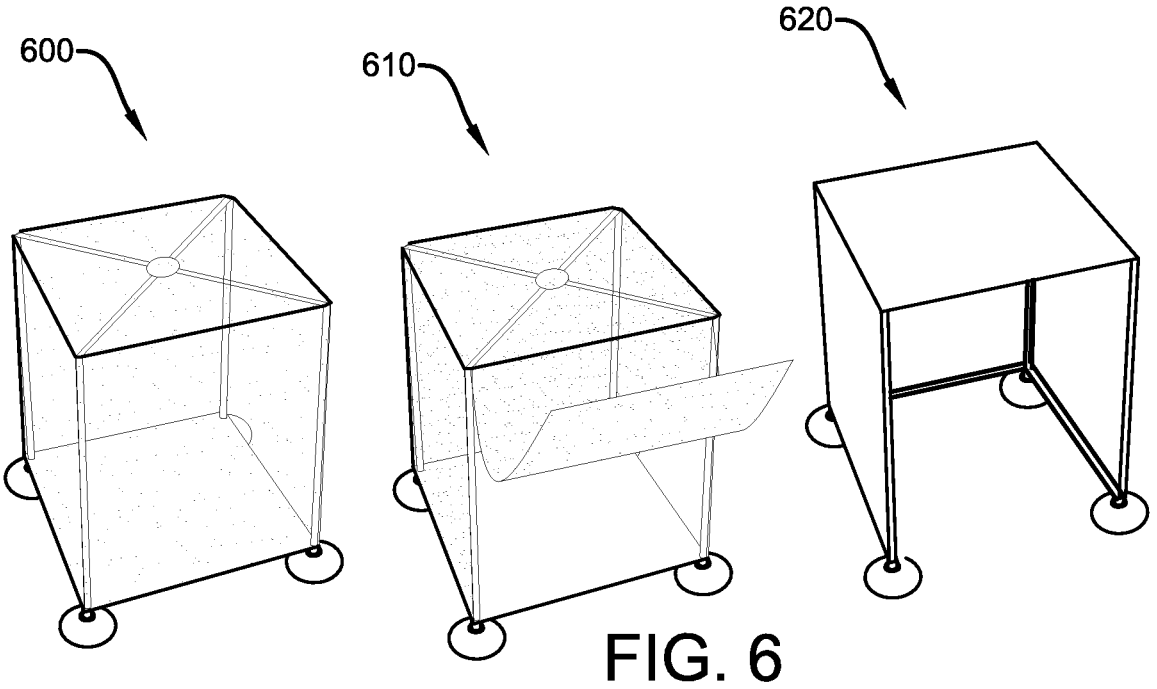
FIG. 6 illustrates a perspective view of a number of potential embodiments of the electronic device canopy of the present invention in accordance with the disclosed architecture.

FIG. 6 illustrates a perspective view of a number of potential embodiments of the electronic device canopy of the present invention in accordance with the disclosed architecture. More specifically, the canopy devices 600, 610, 620 are variants of the electronic device canopy 100 described above, and may be manufactured in different sizes and colors to accommodate user need and/or preference. As previously stated, the handheld electronic device canopy 100, 600, 610, 620 may further comprise logos, indicia, trademarks, geometric patterns, customizable colors and fonts, embroidery and prints and/or images on its surface.

Figure 7:
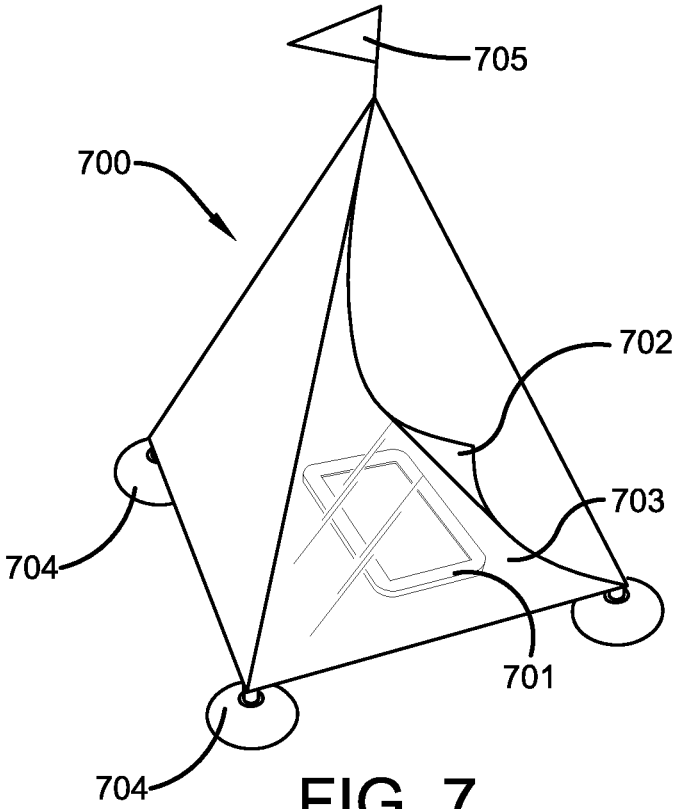
FIG. 7 illustrates a perspective view of one potential embodiment of the electronic device canopy of the present invention in accordance with the disclosed architecture, wherein the front panel of the canopy has been raised to expose the presence of an electronic device stored within the electronic device canopy.

FIG. 7 illustrates a perspective view of one potential embodiment of the electronic device canopy 700 of the present invention in accordance with the disclosed architecture, wherein the front panel of the generally pyramid shaped canopy 700 has been raised to expose the presence of an electronic device 701 stored within the canopy 700. More specifically, the front surface 702 is shown peeled back to reveal a transparent screen 703, which may be removed to gain access to the electronic device 701. The screen 703 is transparent so that the user can view the screen of the electronic device 701 without having to remove the same from the canopy 700. The canopy of FIG. 7 is also provided with a plurality of weighted feet 704, and a flag 705 representing other personalized elements that a user may add to the canopy 700.

Figure 8:
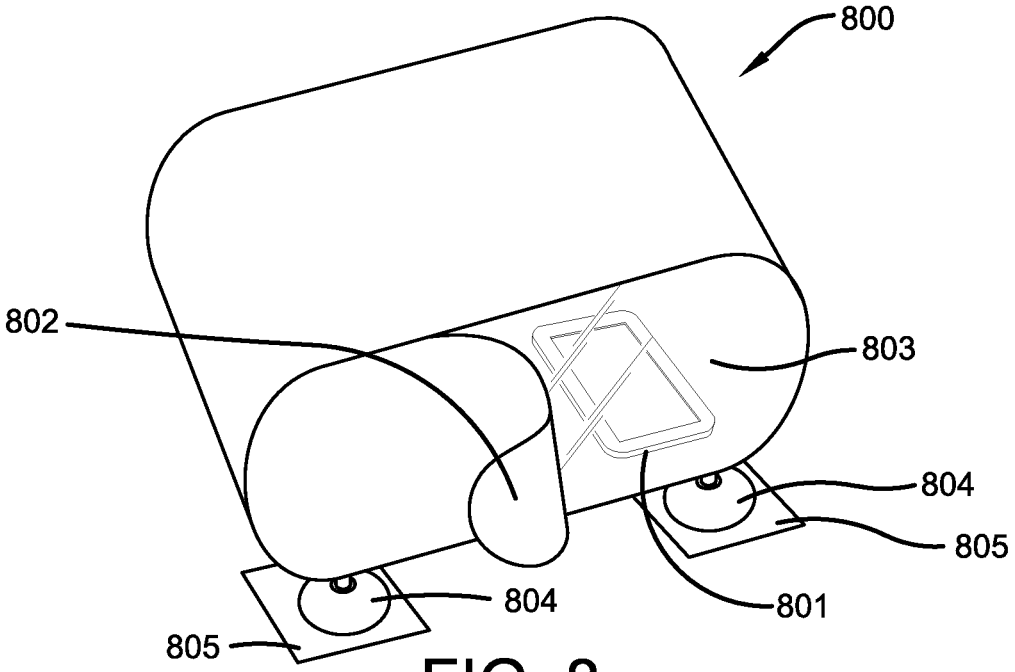
FIG. 8 illustrates a perspective view of one potential embodiment of the electronic device canopy of the present invention in accordance with the disclosed architecture, wherein the front panel of the canopy has been raised to expose the presence of an electronic device stored within the electronic device canopy.

FIG. 8 illustrates a perspective view of yet another potential embodiment of the electronic device canopy 800 of the present invention in accordance with the disclosed architecture, wherein the front panel of the canopy has been raised to expose the presence of an electronic device 801 stored within the electronic device canopy 800. More specifically, the front panel 802 has been partially peeled away to reveal a transparent screen 803. Feet 804 with removable weights 805 are also provided.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "canopy", "cell phone canopy", "handheld electronic device canopy", "device canopy", "Smart device canopy", "shading device" are interchangeable and refer to the handheld electronic device canopy 100 of the present invention.

Notwithstanding the forgoing, the handheld electronic device canopy 100 of the present invention and its various components can be of any suitable size and configuration as is known in the art without affecting the overall concept of the invention, provided that it accomplishes the above stated objectives. One of ordinary skill in the art will appreciate that the size, configuration and material of the handheld electronic device canopy 100 as shown in the FIGS. are for illustrative purposes only, and that many other sizes and shapes of the handheld electronic device canopy 100 are well within the scope of the present disclosure. Although the dimensions of the handheld electronic device canopy 100 are important design parameters for user convenience, the handheld electronic device canopy 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A protective enclosure for a smart device comprising:

a frame comprised of a plurality of leg members and a pair of cross members, wherein each leg member comprises a suction structure for engaging a surface;

a canopy fabric for covering the frame, wherein the canopy fabric and the frame form an interior space, a plurality of side panels, a roof panel, a bottom panel a repositionable front panel, and a plurality of indicia; and a support secured to a bottom end of each of the plurality of leg members; and a flag extending from a top of the protective enclosure; and wherein the canopy fabric is configured to reflect at least 90% of ultraviolet rays; and wherein the plurality of side panels, the roof panel, and the bottom panel are attachable to the frame via a hook and loop fastening system.

2. The protective enclosure as recited in claim 1, wherein each of the pair of cross members are attached to at least two of the plurality of leg members.

3. The protective enclosure as recited in claim 1, wherein the interior space has a head space above the smart device when the smart device is positioned on the bottom panel.

4. The protective enclosure as recited in claim 3, wherein the head space is between 10 to 25 times a size of the smart device.

5. The protective enclosure as recited in claim 1 further comprising a battery, a fan and a temperature sensor in communication with said fan.

6. The protective enclosure as recited in claim 1 further comprising a USB port in communication with a battery.

7. The protective enclosure as recited in claim 1, wherein the frame is repositionable between a deployed position and a collapsed position.

8. The protective enclosure as recited in claim 7, wherein each of the pair of cross members comprise at least one hinge for allowing the frame to be repositioned to the collapsed position.

9. The protective enclosure as recited in claim 1, wherein at least one of the plurality of side panels comprises a pocket facing the interior space.

10. The protective enclosure as recited in claim 1, wherein the support further comprises a removable weight.

11. The protective enclosure as recited in claim 1, wherein at least one of the plurality of side panels comprises a passageway for a charging cable.

12. A canopy device for protecting a smart phone having a dimension, the canopy device comprising:

a shaped canopy configured to support the smart phone and having an air insulation space between 10 and 25 times the dimension of the smart phone sufficient to keep the smart phone from overheating, wherein the shaped canopy is comprised of a plurality of side walls and a top wall; and a frame comprised of a plurality of legs and a plurality of cross members, wherein at least one of the plurality of cross members is attached to at least two of the plurality of legs at a first end of said legs, and further wherein a weighted support is positioned on a second end of each of the plurality of legs;

a battery comprising a USB port for charging the smart phone; and wherein the shaped canopy is waterproof and is configured to reflect at least 90% of ultraviolet rays; and wherein one of the plurality of side walls comprises an outer reflective portion that is repositionable between a completely open position and a completely closed position and a transparent inner screen completely positional between the outer reflective portion and an interior of the shaped canopy; and wherein the outer reflective portion completely covers the transparent inner screen when in the completely closed position.

13. The canopy device as recited in claim 12 further comprising at least one pocket and a fan in electrical communication with said battery.

14. The canopy device as recited in claim 13 further comprising a temperature sensor.

15. A smart device canopy and carrier combination for a smart device comprising:

a shaped canopy comprised of a plurality of sidewalls, a top, a bottom, a transparent screen, and a plurality of indicia, wherein a front sidewall of the plurality of sidewalls comprises an outer reflective portion and is repositionable between an open position and a closed position and the transparent screen is completely positional between the front sidewall and an interior of the shaped canopy and is repositionable between an open position and a closed position independently from the front sidewall;

a carrier having an interior dimension; and a frame comprised of a plurality of mesh leg members interconnected by a plurality of mesh cross members, wherein the frame is repositionable between a first position and a second position, and further wherein the frame only fits within the interior dimension in the first position and not in the second position; and a light configured to illuminate and alert a user when the smart device retained within the shaped canopy receives a communication;

a flag extending from a top of the protective enclosure; and wherein the plurality of sidewalls, the top, and the bottom are configured to reflect at least 90% of ultraviolet rays; and wherein the outer reflective portion completely covers the transparent screen when in the closed position.

16. The smart device canopy and carrier combination as recited in claim 15 further comprising a battery, a fan, and a temperature sensor.

17. The smart device canopy and carrier combination as recited in claim 15, wherein at least one of the plurality of leg mesh members is telescoping.

* * * * *